US006200092B1

(12) United States Patent
Koschier

(10) Patent No.: US 6,200,092 B1
(45) Date of Patent: Mar. 13, 2001

(54) CERAMIC TURBINE NOZZLE

(75) Inventor: Angelo V. Koschier, Lynnfield, MA (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/405,529

(22) Filed: Sep. 24, 1999

(51) Int. Cl.[7] ..... F01D 9/00

(52) U.S. Cl. ..... 415/191; 415/200; 415/208.2; 415/209.3

(58) Field of Search ..... 415/115, 116, 415/139, 191, 200, 208.2, 209.3, 209.4; 416/96 R, 97 R, 97 A, 241 B; 29/889.22, 889.21

(56) References Cited

U.S. PATENT DOCUMENTS 3,619,077 * 11/1971 Wile ..... 415/115
3,992,129 * 11/1976 Booher, Jr. et al. ..... 415/214
4,643,636 * 2/1987 Libertini et al. ..... 415/138
5,630,700 * 5/1997 Olsen et al. ..... 415/134

* cited by examiner

*Primary Examiner*—Edward K. Look
*Assistant Examiner*—Ninh Nguyen
(74) *Attorney, Agent, or Firm*—Andrew C. Hess; Rodney M. Young

(57) ABSTRACT

A turbine nozzle includes ceramic outer and inner bands, with a ceramic vane forward segment integrally joined thereto. A ceramic vane aft segment has opposite ends trapped in complementary sockets in the bands.

19 Claims, 2 Drawing Sheets

CERAMIC TURBINE NOZZLE

The US Government may have certain rights in this invention in accordance with Contract No. N00421-97-C-1464 awarded by the Department of the Navy.

BACKGROUND OF THE INVENTION

The present invention relates generally to gas turbine engines, and, more specifically, to turbine nozzles therein.

In a gas turbine engine, air is pressurized in a compressor, mixed with fuel in a combustor, and ignited for generating hot combustion gases which flow downstream into a turbine which extracts energy therefrom. The turbine includes a turbine nozzle having a plurality of circumferentially spaced apart nozzle vanes supported by integral outer and inner bands. A high pressure turbine nozzle first receives the hottest combustion gases from the combustor and channels those gases to a turbine rotor having a plurality of circumferentially spaced apart rotor blades extending radially outwardly from a supporting disk.

Overall engine efficiency is directly related to the temperature of the combustion gases which must be limited to protect the various turbine components which are heated by the gases. The high pressure turbine nozzle must withstand the high temperature combustion gases from the combustor for a suitable useful life. This is typically achieved by using superalloy materials which maintain strength at high temperature, and diverting a portion of compressor air for use as a coolant in the turbine nozzle.

Superalloy strength is limited, and diverted compressor air reduces the overall efficiency of the engine. Accordingly, engine efficiency is limited in practice by the availability of suitable superalloys, and the need to divert compressor air for cooling turbine nozzles.

Ceramic materials are being considered for the advancement of turbine nozzles to further increase the temperature capability thereof and reduce the use of diverted cooling air therefor. However, conventional ceramic materials available for this purpose have little ductility and require special mounting configurations for preventing fracture damage thereof limiting their useful life.

Turbine nozzle design is further complicated since the nozzle is an annular assembly of vanes which are subject to three dimensional aerodynamic loading and temperature gradients therethrough. Turbine nozzles expand and contract during operation, with attendant thermally induced stress therefrom.

Monolithic ceramic is readily moldable to form, but is relatively weak at integral junctions thereof. Ceramic Matrix Composite (CMC) introduces ceramic fibers in a ceramic matrix for enhanced mechanical strength. The fibers provide strength in the binding matrix. However, the ceramic fibers have little ductility and therefore have limited ability to bend and match the required transitions in a complex three dimensional component, such as a turbine nozzle.

Accordingly, it is desired to provide an improved turbine nozzle formed of ceramic for withstanding the hostile environment of a gas turbine engine.

BRIEF SUMMARY OF THE INVENTION

A turbine nozzle includes ceramic outer and inner bands, with a ceramic vane forward segment integrally joined thereto. A ceramic vane aft segment has opposite ends trapped in complementary sockets in the bands.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
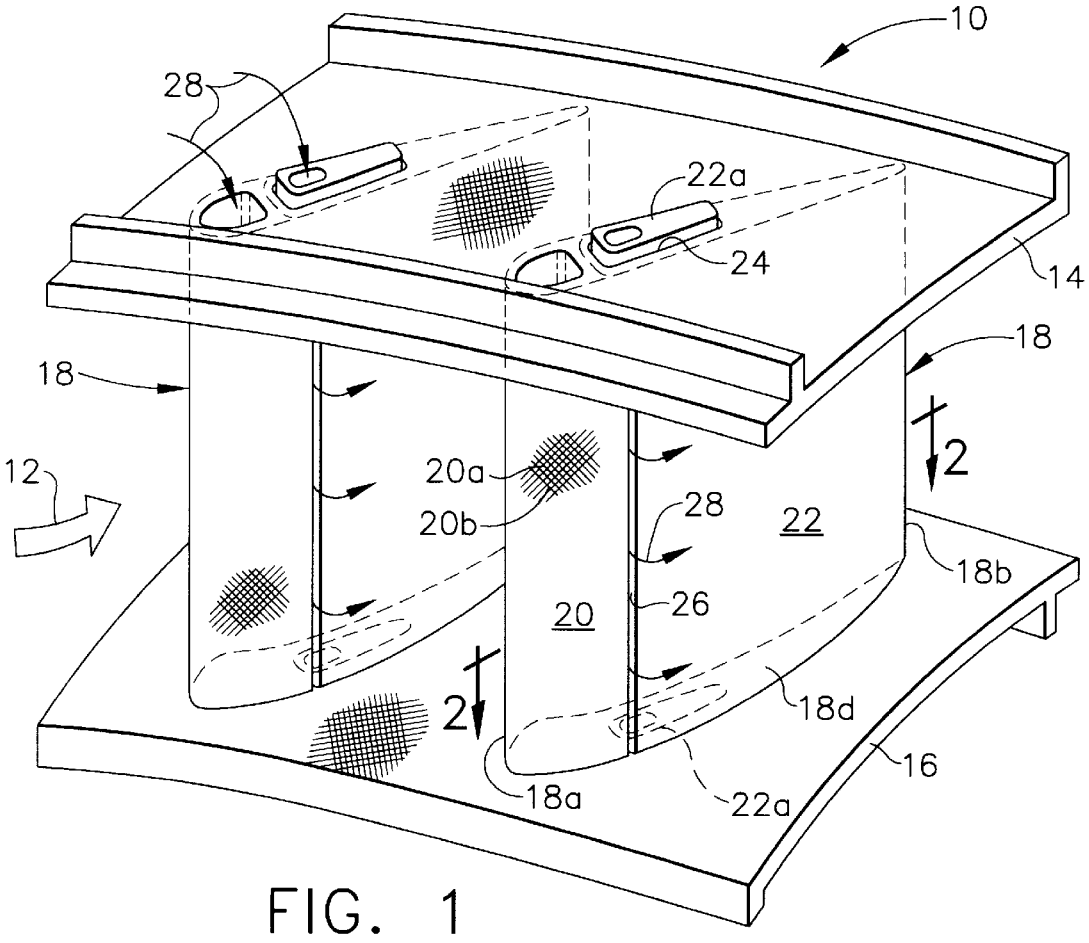
FIG. 1 is an isometric view of a segment of an annular ceramic turbine nozzle in accordance with an exemplary embodiment of the present invention.

Illustrated in FIG. 1 is a portion of an annular high pressure turbine nozzle 10 for use in a gas turbine engine downstream of a combustor thereof which discharges hot combustion gases 12 thereto. The nozzle includes ceramic outer and inner arcuate bands 14,16. The bands may be segments of a ring or may be continuous rings if desired.

Mounted between the outer and inner bands are a plurality of circumferentially spaced apart ceramic vanes 18, with two vanes being illustrated for the exemplary nozzle segment illustrated in FIG. 1. Each vane has a suitable airfoil configuration, such as that illustrated in more particularity in FIG. 2, including axially opposite leading and trailing edges 18*a,b* which join together circumferentially or laterally opposite pressure and suction sides 18*c,d*. The pressure side 18*c* is generally concave and the suction side 18*d* is generally convex as required for turning the combustion gases in accordance with conventional practice.

In order to construct a practical ceramic turbine nozzle, the individual vanes 18 are defined by a pair of complementary vane segments. A vane forward segment 20 is integrally joined at opposite radial ends to corresponding ones of the bands 14,16 in a unitary or one-piece assembly for providing structural strength. A vane aft segment 22 has opposite radially outer and inner ends 22*a* trapped in complementary sockets 24 in respective ones of the bands 14,16.

In this configuration, both vane segments 20,22 may be formed of ceramic in the complex, three dimensional configuration required for the turbine nozzle to achieve suitable strength during operation, notwithstanding the low ductility of the ceramic being used.

Figure 2:
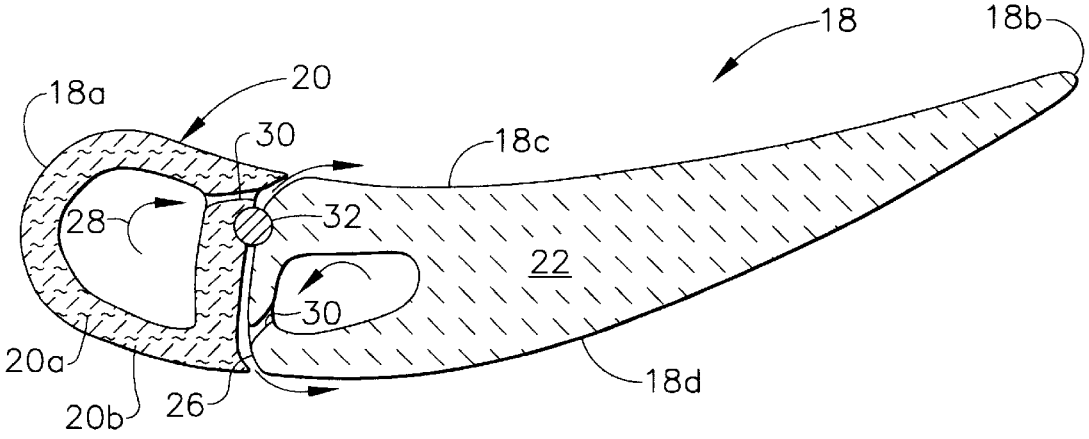
FIG. 2 is a radial sectional view through one of the ceramic vanes illustrated in FIG. 1 and taken along line 2—2.

In the preferred embodiment illustrated in FIGS. 1 and 2, each vane forward segment 20 may be formed using a conventional ceramic matrix composite (CMC) for tailored directional strength in the annular turbine nozzle, and to provide strong joints with the integral bands 14,16. As shown schematically in these Figures, the forward segment 20 preferably includes a ceramic fiber braid 20*a* in a suitable ceramic matrix 20*b*. Ceramic matrix composite materials are conventionally available and may include silicon carbide fibers (SiC) in a silicon carbide matrix (SiC). The fibers and matrix are initially contained in a suitable matrix in a green state, which is generally pliable until processed or cured into the final ceramic state.

Figure 3:
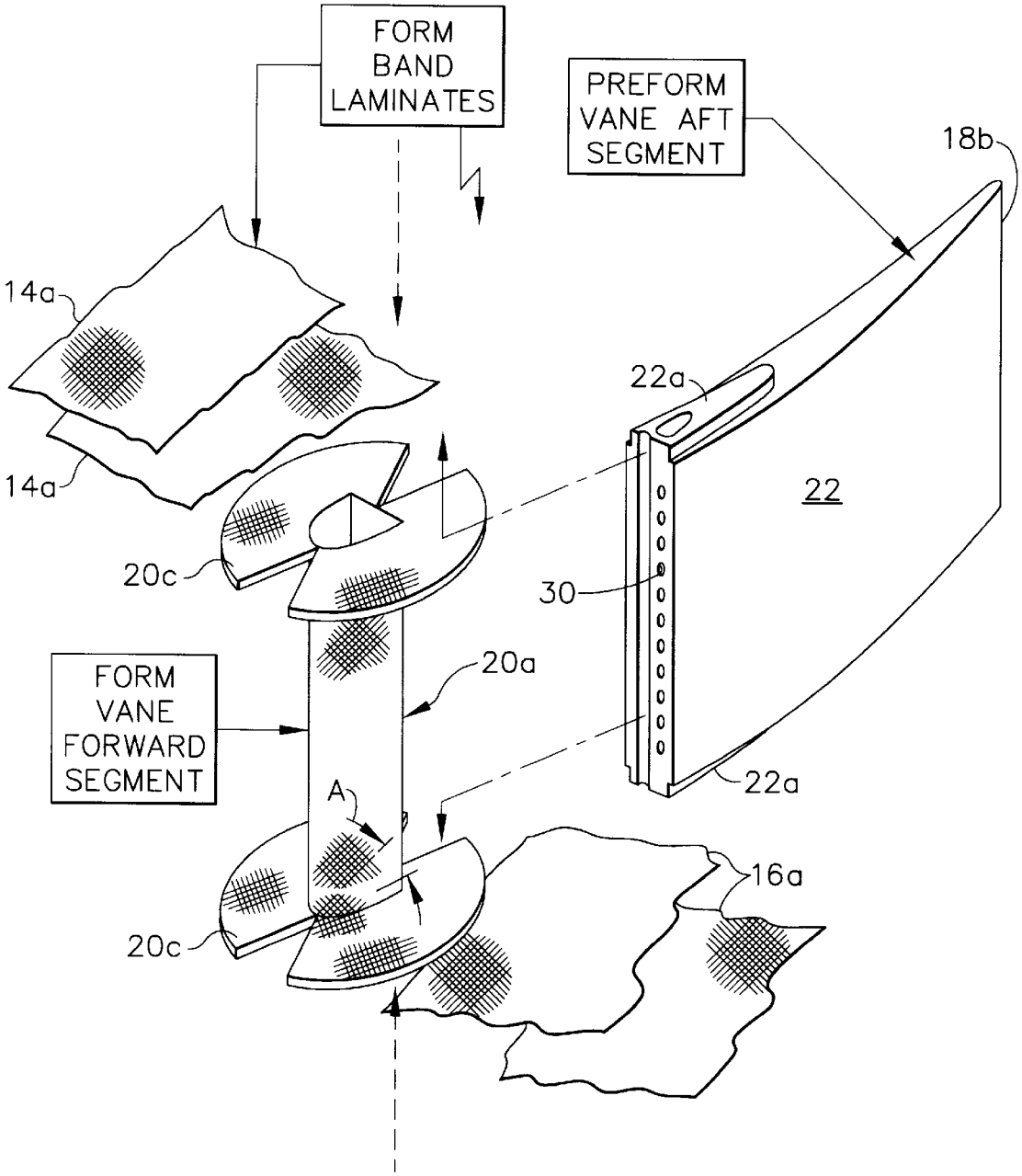
FIG. 3 is a flowchart representation of an exemplary method of making the ceramic turbine nozzle illustrated in FIGS. 1 and 2.

In the preferred embodiment illustrated in FIG. 3, the ceramic fiber braid 20*a* is initially in the form of a tube of continuous fibers without interruption. The tube is readily molded to shape using suitable tooling having the desired profile of the vane forward segment. The outer and inner bands 14,16 are preferably in the form of CMC laminates

14*a*,16*a* which may be suitably laminated with the forward segment braid 20*a* for enhanced strength.

More specifically, the braid tube 20*a* illustrated in FIG. 3 preferably has opposite longitudinal ends split in the form of splayed or mushroomed opposite ends 20*c* which provide integral transitions for lamination with the band laminates. Both the forward segment 20 and the bands 14,16 are preferably formed of CMC of preferably the same ceramic fibers in the same ceramic matrix.

The braid tube 20*a* is configured for forming the leading edge portion of the resulting airfoil over the radial extent required between the bands, and the splayed ends 20*c* may be redirected along the corresponding bands to form, in part, those bands. The splayed ends of the circumferentially adjacent forward segments adjoin each other along the circumference of the bands, and the bands are otherwise completed using CMC tape or cloth laminates for the required configuration thereof. Upon processing or curing, the green forward segments and bands become rigid in their final ceramic state and provide a unitary structural assembly of these components.

A particular advantage of this assembly is that the vane forward segments 20 are formed of braid tubes having maximum strength capability by the interwoven fibers thereof. Since those fibers are ceramic they have little ductility yet may be integrally formed with the bands with or without the splayed ends 20*c*.

As shown is FIG. 3, the ceramic fibers in the braid 20*a* preferably transition from the vane forward segment to the opposite outer and inner bands at oblique angles A over the resulting corner radius formed between the forward segment and the bands. The oblique angles may be up to about forty five degrees in the preferred embodiment for minimizing the resulting radius at the vane-band intersection due to the relatively rigid ceramic fibers.

Accordingly, the splayed braid ends 20*c* provide structural integrity with the outer and inner bands 14,16 laminated thereto, and provide main strength for the turbine nozzle. The braid ends may be cross-stitched with the band laminates, or sandwiched therewith. The ceramic fibers in the vane forward segment and bands may be preferentially oriented for maximizing nozzle strength in the required directions for the three dimensional loading and differential temperatures experienced during operation.

As initially shown in FIG. 2, the individual vane 18 has an aerodynamic crescent profile with a relatively large radius leading edge 18*a* and a relatively thin radius trailing edge 18*b*. The trailing edge radius is typically about ten mils as required for maximizing aerodynamic performance of the nozzle. Such thin trailing edges further complicate the design of a composite turbine nozzle in view of inherent limitations in ceramic construction. Since ceramic fibers have little ductility, it is typically not possible to bend those fibers around the small radii required for a thin trailing edge. Furthermore, the ply thickness of CMC composite material is also typically larger than the thinness of the vane trailing edge.

Since the vanes are configured to channel combustion gases, they are highly loaded under gas pressure and are subject to the high temperature thereof causing differential thermal expansion and contraction during operation. And, since the vane trailing edges are relatively thin, little room is available for providing cooling thereof.

Accordingly, in the preferred embodiment illustrated in FIGS. 1–3, each vane aft segment 22 comprises a monolithic ceramic without reinforcing ceramic fibers therein. Monolithic ceramic is conventional, such as silicon nitride ($Si_3N_4$). Although the vane aft segments 22 are preferably formed of toughened monolithic ceramic, they may be formed of a ceramic composite with reinforcing ceramic fibers therein, typically in an orientation other than that found in the forward segments 20.

For example, whereas the fibers in the forward segments 20 are preferably oriented at the oblique orientation angle A, fibers used in the aft segments 22 would preferably extend in the radial direction between the opposite ends of the segment for enhancing radial strength of the trailing edge. In view of the preferred radial orientation of fibers in the aft segments, or in view of the otherwise monolithic construction thereof, special mounting of the aft segments to the outer and inner bands complements the nozzle assembly and its strength.

As indicated above, the vane aft segments 22 are preferably separate and distinct from the integrated vane forward segments and bands. The structural frame defined by the forward segments and bands may be used to advantage to mechanically trap the individual aft segments in position adjacent to their corresponding forward segments to complete the individual aerodynamic vanes.

As shown in FIGS. 1 and 3, the radially outer and inner opposite ends 22*a* of each aft segment is preferably in the form of an axially elongate support key extending away from the segment. The support keys 22*a* are simply trapped in complementary seats or sockets 24 formed in the corresponding outer and inner bands for retaining the individual aft segments therebetween and carrying vane torque thereto. In this construction, the aft segments are permitted to expand and contract radially relative to the outer and inner bands in which they are trapped. And, aerodynamic torque loads on the aft segments is carried through the support keys 22*a* into the corresponding bands.

In this way, the CMC vane forward segments 20 define a structural frame, with the outer and inner bands being reinforced with ceramic fibers. And, the thin vane aft segments may be specifically configured in profile for maximizing aerodynamic efficiency, and may be trapped between the bands for retention. Monolithic ceramic may therefore be used to advantage selectively for the aft segments, although in alternate embodiments the aft segments may be reinforced with fiber where practical.

In the two-segment construction illustrated in FIG. 2 for example, the vane aft segment 22 is preferably spaced from the vane forward segment 20 to define a small gap 26 therebetween. Either or both vane segments 20,22 may be hollow in the radial direction for channeling a coolant 28, such as compressor bleed air, therethrough. Each segment may also include a row of discharge holes 30 hidden within the gap for discharging the coolant into the gap during operation. In this way, the coolant may be channeled through each vane segment for internal cooling thereof in any suitable manner, with the coolant then being discharged into the gap 26 for generating a film of cooling air as the coolant flows downstream over the outer surfaces of the aft segment.

Since a differential pressure is created between the opposite sides 18*c*,*d* of each vane during operation, each vane preferably includes a seal 32 disposed between the vane forward and aft segments 20,22 inside the gap 26 as shown in FIG. 2 to seal fluid flow therepast. The seal 32 may have any suitable configuration such as a ceramic rope seal trapped in complementary recesses within the faces defining the gap 26. The seal prevents hot combustion gas travel through the gap 26, while permits discharge of the coolant 28 through the gap 26 on opposite lateral sides of the seal.

FIG. 3 illustrates schematically a preferred method of making the ceramic turbine nozzle 10 illustrated in FIGS. 1 and 2. Each vane aft segment 22 is preferably preformed in any suitable manner, such as by molding monolithic material in the desired configuration of the aft segments.

The individual ceramic fiber tubes 20*a* are formed in their green state into the desired configuration of the vane forward segments to complement the corresponding aft segments 22 and to collectively define the individual vanes 18. The splayed ends 20*c* of each forward segment are then laminated with the ceramic cloth of the outer and inner bands in their green state.

In this way, the ceramic components of the forward segments and bands are formed or molded to the required shape using suitable tooling or forms, with the individual pre-formed aft segments 22 being assembled thereto. The aft segments are therefore trapped between the bands and behind the corresponding forward segments during the assembly process.

The green bands and forward segments are then conventionally processed or cured to form the hardened ceramic nozzle, with the aft segments being mechanically trapped therein.

In this preferred construction, the vane aft segments 22 are preferably pre-cured ceramic, such as monolithic ceramic without reinforcing ceramic fibers. And, the vane forward segments 20 and bands 14,16 are ceramic matrix composite constructions having reinforcing ceramic fibers therein to provide structural integrity and strength to the entire assembly. In this construction, the strength advantages of the tube braid 20*a* are used to integrate the vane forward segments with the bands, with the vane aft segments 22 being mechanically retained or trapped in the bands. The aft segments are axially and circumferentially retained to the bands, but are free to expand and contract radially between the bands within the supporting sockets 24.

The different advantages of ceramic matrix composite and monolithic ceramic are preferentially used in constructing the turbine nozzle for maximizing the integrity and durability thereof. The relative sizes of the vane forward and aft segments 20,22 may be adjusted as desired consistent with the manufacturing capabilities of CMC and monolithic ceramic materials.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

1. A turbine nozzle comprising:

ceramic outer and inner bands;

a ceramic vane forward segment integrally joined at opposite ends to said bands; and a ceramic vane aft segment having opposite ends trapped in complementary sockets in said bands.

2. A nozzle according to claim 1 wherein said vane forward segment comprises a ceramic matrix composite.

3. A nozzle according to claim 2 wherein said vane forward segment further comprises a ceramic fiber braid in a ceramic matrix.

4. A nozzle according to claim 3 wherein said braid comprises a tube having splayed opposite ends laminated into said bands.

5. A nozzle according to claim 3 wherein said ceramic fibers in said braid transition from said vane forward segment to said bands at oblique angles.

6. A nozzle according to claim 3 wherein said bands comprise ceramic matrix composite laminated with said vane forward segment.

7. A nozzle according to claim 3 wherein said vane aft segment comprises monolithic ceramic.

8. A nozzle according to claim 7 wherein said vane aft segment further comprises support keys at said opposite ends thereof trapped in said complementary sockets for retaining said vane aft segment between said bands and carrying vane torque thereto.

9. A nozzle according to claim 8 wherein said vane aft segment is spaced from said vane forward segment to define a gap therebetween.

10. A nozzle according to claim 9 wherein at least one of said vane forward and aft segments is hollow for channeling a coolant therethrough, and said one segment includes a row of discharge holes for discharging coolant into said gap.

11. A nozzle according to claim 10 further comprising a seal disposed between said forward and aft segments inside said gap to seal fluid flow therepast.

12. A turbine nozzle comprising:

ceramic outer and inner bands;

a ceramic matrix composite vane forward segment integrally joined at opposite ends to said bands; and a monolithic ceramic vane aft segment having opposite ends trapped in complementary sockets in said bands.

13. A nozzle according to claim 12 wherein said vane forward segment further comprises a ceramic fiber tube braid in a ceramic matrix, and having splayed opposite ends laminated into said bands.

14. A nozzle according to claim 13 wherein said vane aft segment further comprises support keys at said opposite ends thereof trapped in said complementary sockets for retaining said vane aft segment between said bands and carrying vane torque thereto.

15. A nozzle according to claim 14 wherein ceramic fibers in said braid transition from said vane forward segment to said bands at oblique angles.

16. A method of making a ceramic turbine nozzle comprising:

forming a ceramic vane aft segment;

forming a green ceramic fiber tube in a vane forward segment complementary with said aft segment;

laminating said forward segment with green outer and inner bands;

trapping said aft segment between said bands and behind said forward segment; and curing said green bands and forward segment to form said ceramic nozzle with said aft segment trapped therein.

17. A method according to claim 16 wherein said aft segment is pre-cured ceramic.

18. A method according to claim 17 wherein said aft segment is monolithic ceramic.

19. A method according to claim 18 wherein said forward segment and bands are ceramic matrix composite.

* * * * *